US008286699B2

(12) United States Patent
Ingraham

(10) Patent No.: US 8,286,699 B2
(45) Date of Patent: Oct. 16, 2012

(54) MULTIPLE PRODUCTION STRING APPARATUS

(75) Inventor: Derek Ingraham, Conroe, TX (US)

(73) Assignee: Smith International, Inc., Houston, TX (US)

( * ) Notice: Subject to any disclaimer, the term of this patent is extended or adjusted under 35 U.S.C. 154(b) by 328 days.

(21) Appl. No.: 12/650,191

(22) Filed: Dec. 30, 2009

(65) Prior Publication Data

US 2010/0170677 A1 Jul. 8, 2010

Related U.S. Application Data

(60) Provisional application No. 61/142,112, filed on Dec. 31, 2008.

(51) Int. Cl.
*E21B 7/06* (2006.01)
*E21B 23/00* (2006.01)

(52) U.S. Cl. ..... 166/117.6; 166/50; 166/242.3; 166/242.6; 166/381

(58) Field of Classification Search ..... 166/313, 166/369, 381, 50, 117.5, 117.6, 241.1, 242.3, 166/242.6
See application file for complete search history.

(56) References Cited

U.S. PATENT DOCUMENTS

| | | | | |
|---|---|---|---|---|
| 5,499,680 | A | 3/1996 | Walter et al. | |
| 6,158,513 | A * | 12/2000 | Nistor et al. | 166/313 |
| 6,732,801 | B2 * | 5/2004 | Ohmer et al. | 166/313 |
| 2001/0009189 | A1 | 7/2001 | Brooks et al. | |
| 2002/0100614 | A1 | 8/2002 | Bergeron | |
| 2009/0255664 | A1 | 10/2009 | Hart et al. | |
| 2010/0163240 | A1 * | 7/2010 | Ingraham et al. | 166/313 |

FOREIGN PATENT DOCUMENTS

| | | |
|---|---|---|
| GB | 2340152 A | 2/2000 |
| WO | 9939077 | 8/1999 |

OTHER PUBLICATIONS

Examination Report issued in corresponding British Patent Application No. GB0922688.7; Dated Dec. 9, 2010 (2 pages).
Search Report dated Mar. 22, 2010 for Patent Application No. GB0922688.7.

* cited by examiner

*Primary Examiner* — Shane Bomar
*Assistant Examiner* — Catherine Loikith

(57) ABSTRACT

A production tubing assembly for accessing multiple boreholes. The assembly includes an outer shroud having an axial throughbore, a deflector disposed in the axial throughbore and releasably coupled to the outer shroud. At least two tubular members are releasably coupled to the deflector by extendable latch assemblies, wherein the deflector with the coupled tubular members is extendable from within the outer shroud to a position beyond the outer shroud. Additionally, in the extended position, the latch assemblies extend to release the tubular members and latch the deflector to the outer shroud.

22 Claims, 20 Drawing Sheets

MULTIPLE PRODUCTION STRING APPARATUS

CROSS-REFERENCE TO RELATED APPLICATIONS

The present application claims the benefit of U.S. Provisional Application Ser. No. 61/142,112, filed Dec. 31, 2008, entitled Dual Production String Apparatus.

BACKGROUND

This disclosure relates generally to hydrocarbon exploration and production, and in particular, to managing placement of wellbore tubulars in a borehole to facilitate hydrocarbon exploration and production.

A borehole may be drilled into the ground to explore and produce a hydrocarbon reservoir therein. This borehole may be referred to as the main or primary borehole. To further explore and/or increase production from the reservoir, one or more lateral boreholes may be drilled which branch from the main borehole. Such drilling extends the reach of the well into laterally displaced portions of the reservoir. During downhole operations, it may be necessary to separately and selectively enter the main and lateral boreholes with a wellbore tubular or tubulars. The wellbore tubulars, or tubing strings, can be used to establish flow or access paths in the multiple boreholes. For example, production strings can be guided to the main and lateral boreholes, and sealed, to provide fluid flow paths from the multiple boreholes into the primary well extending to the surface.

The principles of the present disclosure are directed to overcoming one or more of the limitations of the existing apparatus and processes for providing production access to multiple boreholes.

SUMMARY

An embodiment of a production tubing assembly for accessing multiple boreholes includes an outer shroud having an axial throughbore, a deflector disposed in the axial throughbore and releasably coupled to the outer shroud, and at least two tubular members releasably coupled to the deflector by extendable latch assemblies, wherein the deflector with the coupled tubular members is extendable from within the outer shroud to a position beyond the outer shroud, wherein, in the extended position, the latch assemblies extend to release the tubular members and latch the deflector to the outer shroud. The deflector may extend toward a junction with a main borehole and a lateral borehole. The tubular members may be further extendable into the main and lateral boreholes. The deflector may be releasably coupled to the outer shroud by shear members. The latch assemblies may include spring-loaded latch members. The latch members may include an outer latch surface and an inner tubular gripping surface. The latch members, in the extended position, may expand into recesses in the outer shroud. The assembly may further include a wicker assembly coupled between the tubular members and the outer shroud for one directional movement of the tubular members relative to the outer shroud. The wicker assembly may allow downward movement of the tubular members and prevent upward movement of the tubular members for retrieval of the assembly. The wicker assembly may include spring-loaded ratchet members. The ratchet members may include gripping surfaces and the tubular members may include mating gripping surfaces to form a uni-directional gripping interface. The deflector may be aligned in the main borehole and slidingly received by an integral deflector in the main borehole. The deflector may include a ramp to deflect one of the tubular members into the lateral borehole.

An embodiment of a production tubing assembly for accessing multiple boreholes includes an outer shroud having an axial throughbore and an inner recess, a deflector slidably disposed in the axial throughbore and releasably coupled to the outer shroud, at least two tubular members supported by the deflector, and a latch assembly disposed in a portion of the deflector between the outer shroud and the two tubular members, the latch assembly comprising at least one latch member having a tubular gripping surface and a latch surface to engage the inner recess of the outer shroud. The deflector may include a retracted position wherein the outer shroud forces the latch member gripping surface into engagement with one of the tubular members, and an extended position wherein the latch member is biased into the inner recess of the outer shroud to release the gripping surface from the tubular member and latch the deflector to the outer shroud. The assembly may further include a wicker assembly coupled between at least one of the tubular members and the outer shroud, the wicker assembly including at least one ratchet member having a gripping surface mating with a gripping surface of the tubular member to form a uni-directional gripping interface.

A method for accessing multiple boreholes with a production tubing assembly includes lowering the tubing assembly into a primary well, wherein the tubing assembly comprises a deflector coupled to an outer shroud and at least two tubular members coupled to the deflector, disposing the tubing assembly adjacent a junction between a main borehole and a lateral borehole, releasing the deflector from the outer shroud, extending the deflector and the tubular members from the outer shroud, releasing the tubular members from the deflector, latching the deflector to the outer shroud, and extending the tubular members into the main and lateral boreholes.

The method may further include coupling the deflector to the outer shroud with shear members, and wherein releasing the deflector from the outer shroud comprises shearing the shear members. The method may further include coupling the two tubular members to the deflector with latch members having gripping surfaces, and wherein releasing the tubular members from the deflector and latching the deflector to the outer shroud comprises biasing the latch members away from the tubular members and into recesses in the outer shroud. The method may further include lifting the two tubular members, and retrieving the tubing assembly to the surface of the primary well. Retrieving the tubing assembly to the surface of the primary well may further include coupling a wicker assembly between the two tubular members and the outer shroud, and wherein the wicker assembly comprises a uni-directional gripping interface with the tubular members allowing downward movement of the tubular members relative to the outer shroud and preventing upward movement of the tubular members relative to the outer shroud.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
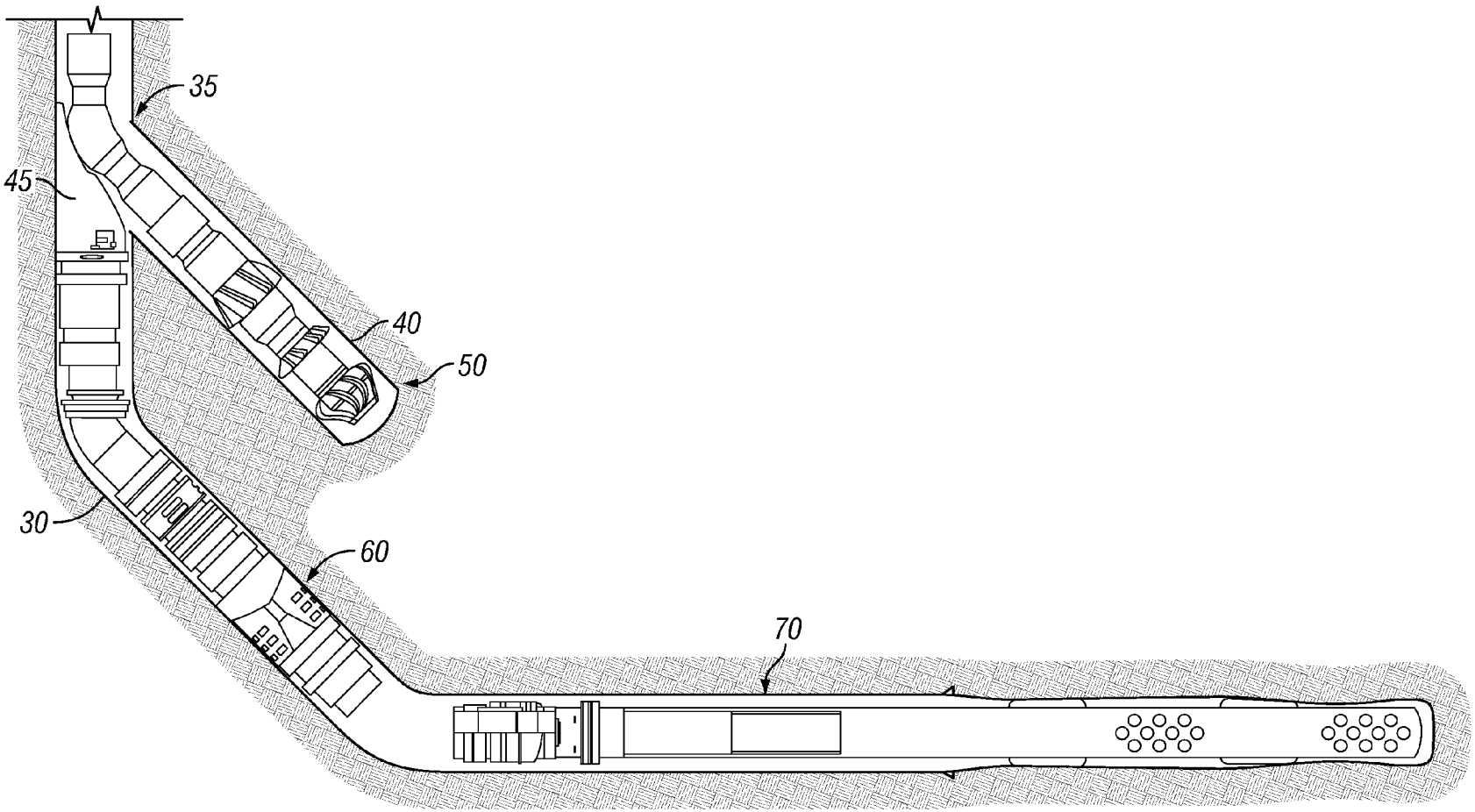
FIG. 1 is a schematic view of a system for milling and drilling a lateral borehole from a primary borehole.

In the drawings and description that follow, like parts are typically marked throughout the specification and drawings with the same reference numerals. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results.

In the following discussion and in the claims, the terms "including" and "comprising" are used in an open-ended fashion, and thus should be interpreted to mean "including, but not limited to . . . ". Unless otherwise specified, any use of any form of the terms "connect", "engage", "couple", "attach", or any other term describing an interaction between elements is not meant to limit the interaction to direct interaction between the elements and may also include indirect interaction between the elements described. The terms "pipe," "tubular member," "casing" and the like as used herein shall include tubing and other generally cylindrical objects. In addition, in the discussion and claims that follow, it may be sometimes stated that certain components or elements are in fluid communication or fluidly coupled. By this it is meant that the components are constructed and interrelated such that a fluid could be communicated between them, as via a passageway, tube, or conduit. The various characteristics mentioned above, as well as other features and characteristics described in more detail below, will be readily apparent to those skilled in the art upon reading the following detailed description of the embodiments, and by referring to the accompanying drawings.

Figure 2:
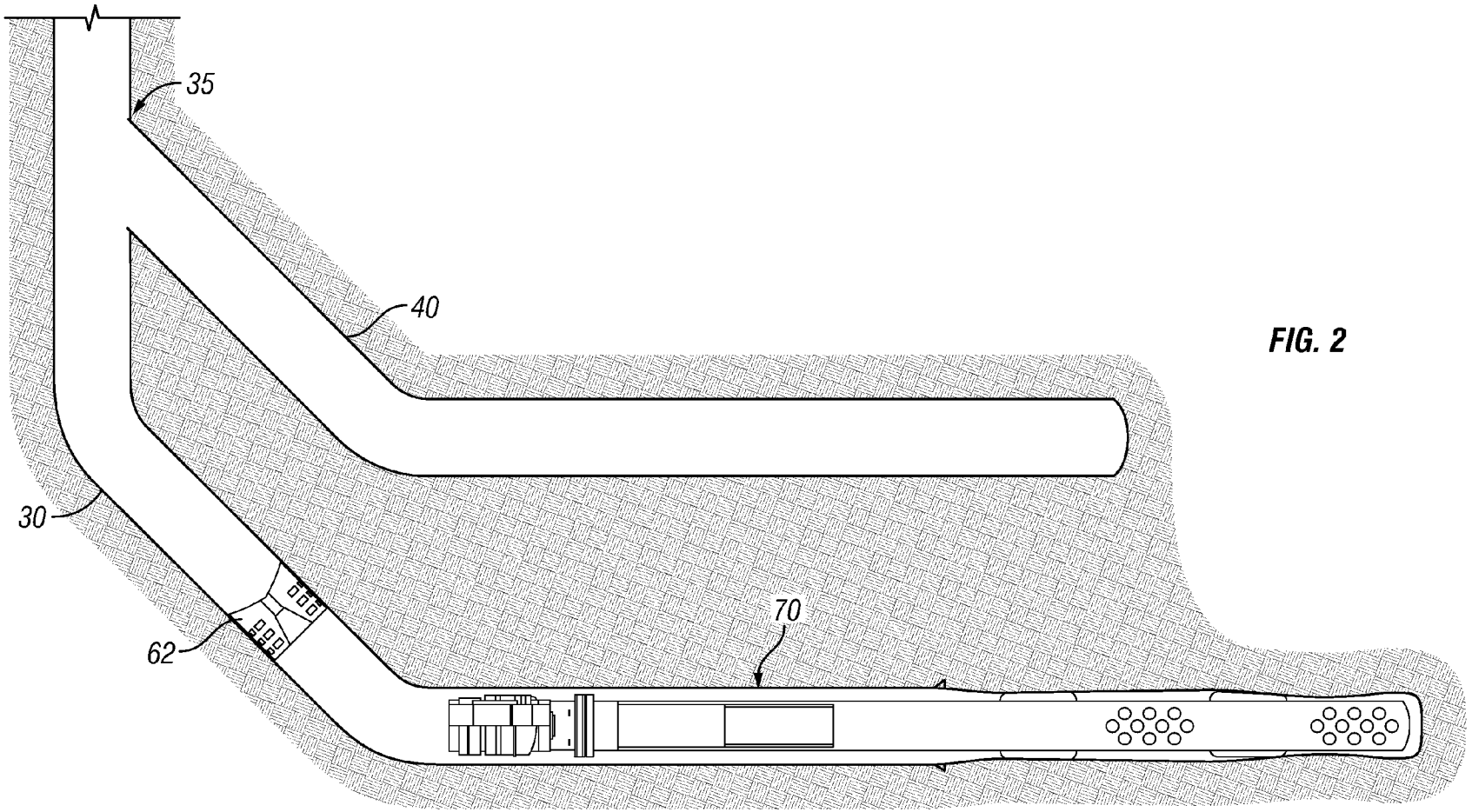
FIG. 2 is a schematic view of the finished junction between the lateral borehole and the primary borehole including downhole operations equipment.

Referring initially to FIG. 1, a primary or main borehole 30 is drilled in a conventional manner and may include operational equipment 60, such as a whipstock and anchor system, or a fracturing and/or production system 70. A diverter or whipstock 45 is used to guide a milling and/or drilling assembly 50 laterally relative to the primary borehole 30 for creating a lateral or secondary borehole 40 having a junction 35 with the primary borehole 30. Referring now to FIG. 2, the finished junction 35 and lateral borehole 40 are shown. Well treatment, completion or production equipment 70 may remain in the primary borehole 30 along with an orientator or locator 62 for receiving additional downhole tools.

Figure 3:
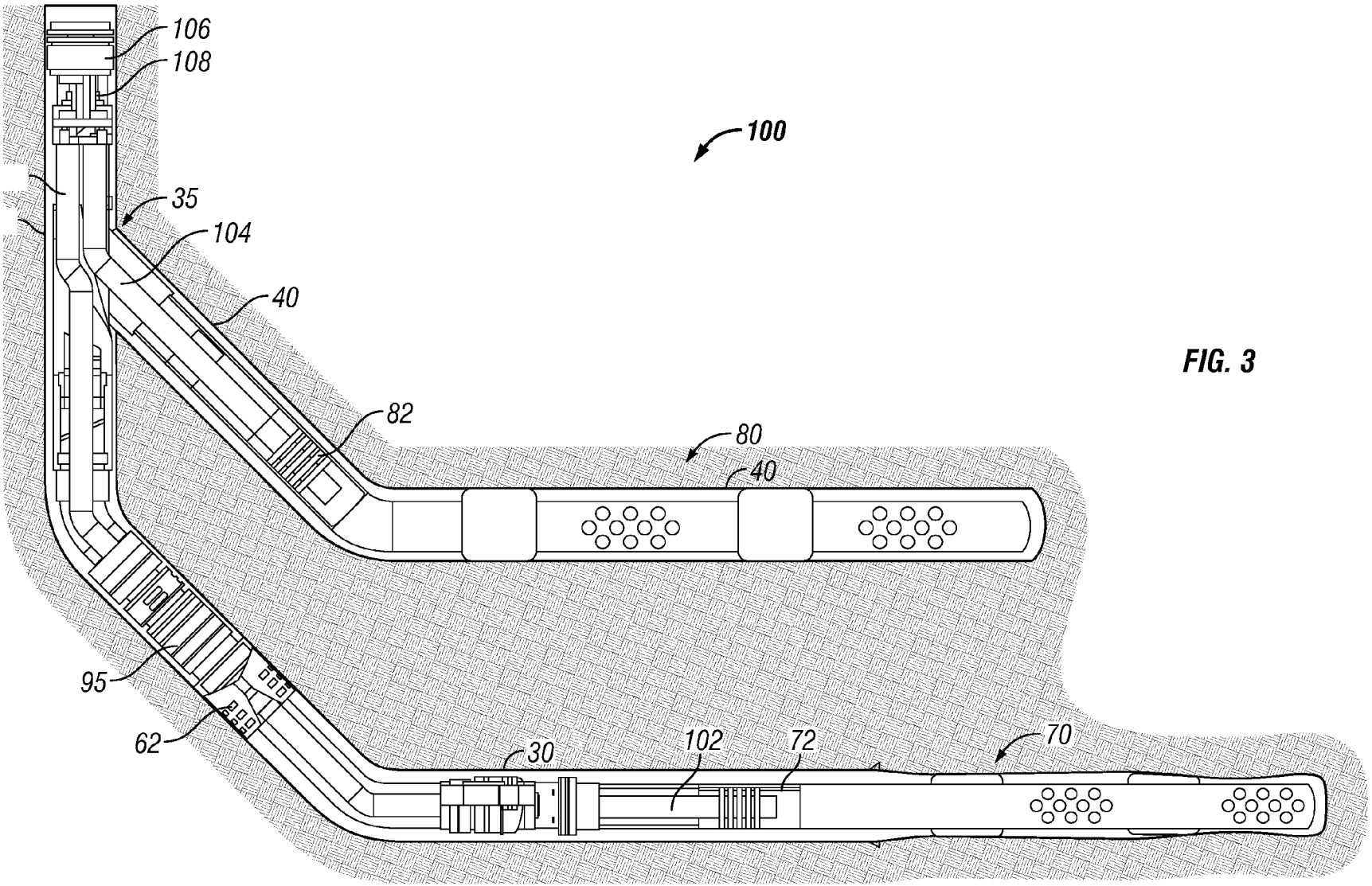
FIG. 3 is a schematic view of an embodiment of a deflector and multiple tubing string assembly in accordance with principles herein disposed in the junction of FIG. 2.

Referring next to FIG. 3, a production tubing system or assembly 100 is shown in accordance with the principles of the present disclosure. The production tubing assembly 100 is adapted for providing a pressure seal, which isolates the lateral borehole 40 from the main borehole 30 and vice versa, to the two (or multiple) bores for production access. Because the production tubing assembly is a junction block, it may also be referred to as a Y-block 100. The Y-block 100 is also designed to provide a stackable level 5 junction. In some embodiments, the Y-block apparatus 100 self aligns on a mule shoe downhole and latches to the top of the junction 35. When latched, a deflector with dual strings 102, 104 attached advances into the junction 35. Once the deflector is in place in the junction 35, the deflector selectively guides the strings 102, 104 into the main and lateral bores. The string 102 lands in a polished bore receptacle 72 of the production equipment 70 and the string 104 lands in a polished bore receptacle 82 of production equipment 80. For purposes of simplicity and clarity, the strings 102, 104 and the equipment 70, 80 will be referred to as production strings and equipment, though other tubular members and downhole equipment are contemplated. The positioned assembly 100 and production strings 102, 104 will effect a seal in the bores of the production equipment 70, 80 in the main and lateral bores to complete the well. A packer assembly 95 and other downhole equipment may also be provided in the boreholes 30, 40.

In some embodiments, a diverter 108 is disposed at the top of the Y-block 100 that selectively allows access to either bore for future intervention work needed downhole. The diverter 108 may stay in place and can be rotated by means of multi-cycle "J" grooves to allow access to the desired bore. A packer 106, with a seal bore receptacle, is set at the top of the Y-block apparatus 100 to lock the assembly in place. If another junction is created in the main borehole 30 above the original junction 35, a packer is provided to seal access to the lower junction 35, making the Y-block 100 stackable. Additional details regarding the components of the Y-block 100 and its operation are discussed below, showing that the apparatus 100 allows multiple production strings to be selectively and controllably guided to the lateral and main bores, and that the in place diverter allows the Y-block system to be stacked on top of another in the well.

Figure 4:
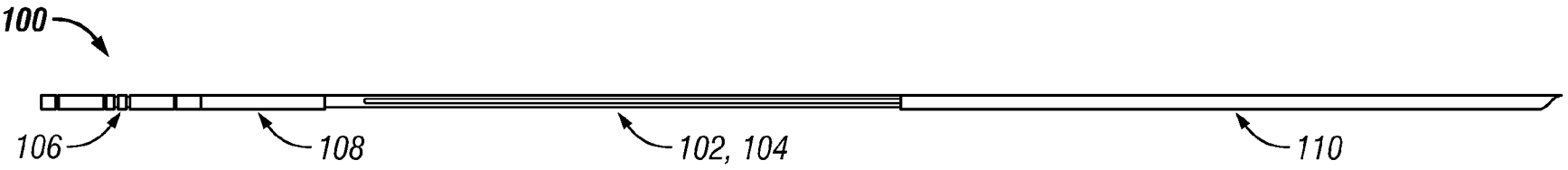
FIG. 4 is a side, elevation view of an embodiment of a production string assembly in accordance with principles herein.
Figure 5:
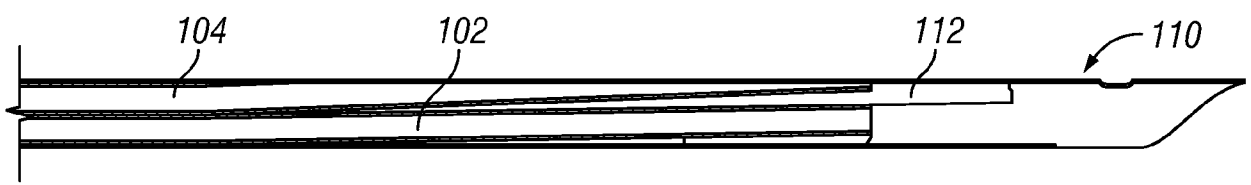
FIG. 5 is an enlarged, cross-section view of a shroud portion of the production string assembly of FIG. 4.
Figure 6:
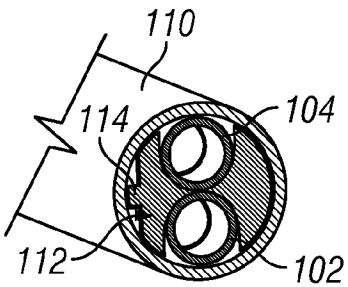
FIG. 6 is a radial section view of the shroud portion of FIGS. 4 and 5 showing the aligned tubing deflector and production strings.
Figure 7:
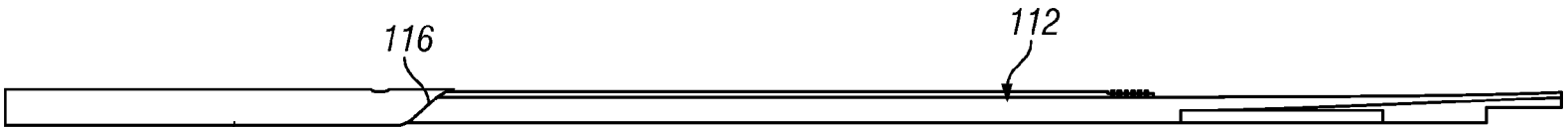
FIG. 7 is side view of the shroud portion of FIGS. 4 and 5 with a tubing deflector extended therefrom.

Referring now to FIG. 4, a side elevation view of the multiple production string assembly 100 is shown. An upper end of the assembly 100 includes the packer 106, followed by the diverter 108, the tubing strings 102, 104 and an outer shroud 110. In some embodiments, the diverter 108 is disposed above the packer 106 and is separately retrievable consistent with other teachings herein. As shown in the cross-section view of FIG. 5, the shroud 110 houses ends of the adjacent tubing strings 102, 104 which are supported by a tubing deflector 112. The radial section view of the shroud 110 as shown in FIG. 6 illustrates the tubing deflector 112 having an alignment feature 114 and supporting the tubing strings 102, 104. Referring to FIG. 7, the tubing deflector 112 is shown in an extended position beyond an end 116 of the shroud 110.

Figure 8:
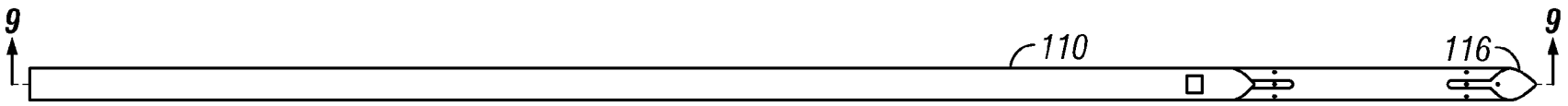
FIG. 8 is a top view of the shroud assembly in detail.
Figure 9:
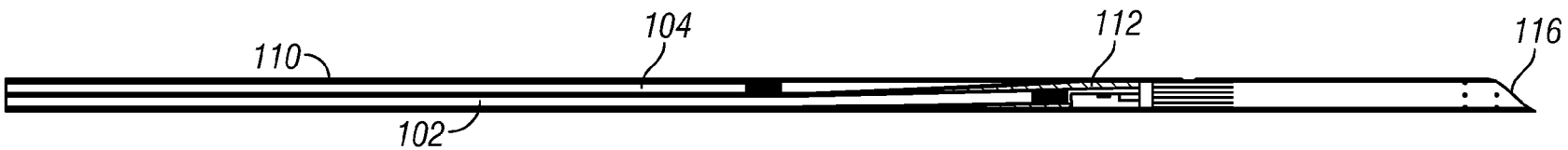
FIG. 9 is a side cross-section view of the shroud assembly of FIG. 8.
Figure 10:
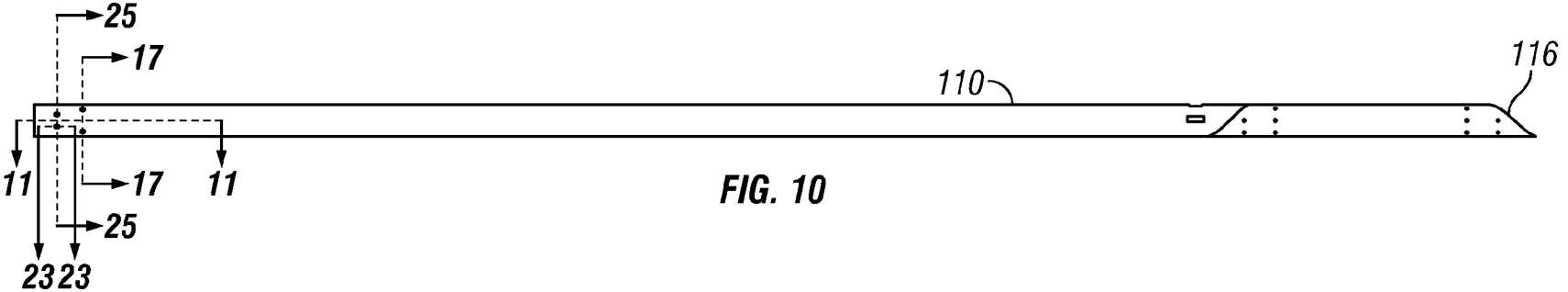
FIG. 10 is a side view of the shroud assembly of FIG. 8.

Referring now to FIGS. 8-10, the shroud 110 is isolated and shown in detail. FIG. 8 shows a top view of the shroud 110 including the end 116 for mating with a downhole mule shoe or other locator. FIG. 9 shows a side, cross-section view of the shroud 110 revealing the inner tubing strings 102, 104 and supporting deflector 112. FIG. 10 shows a side view of the shroud 110, with various cross-sectional lines shown for subsequent figures.

Figure 11:
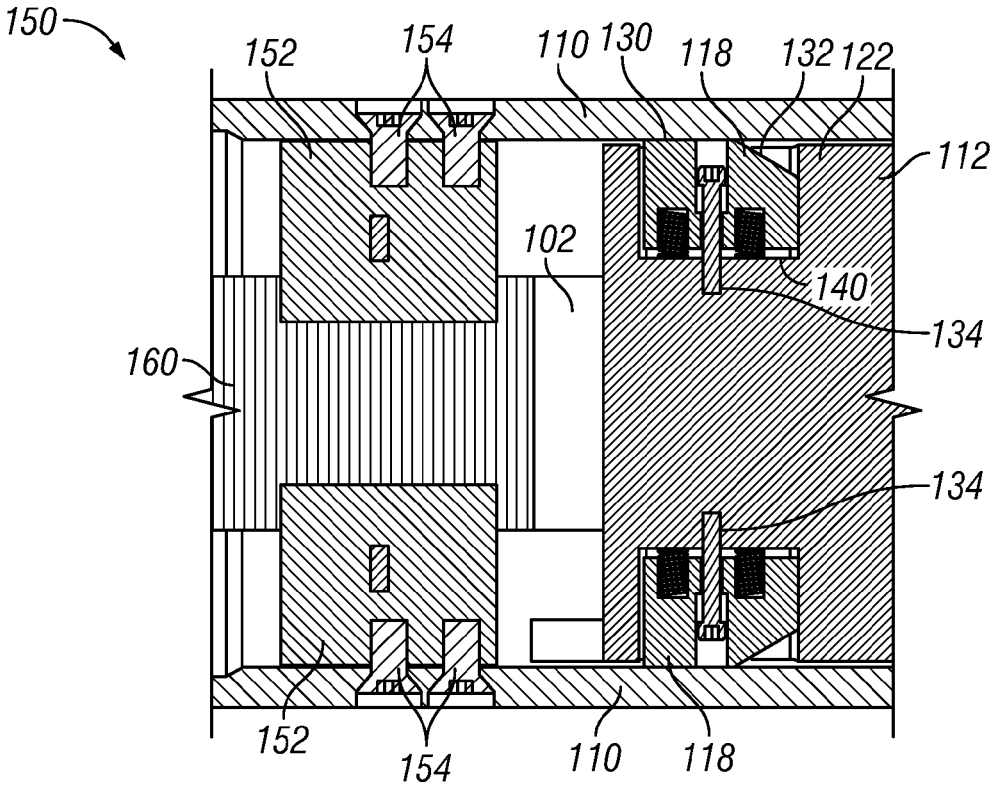
FIGS. 11 and 13 are cross-section views of a retracted position of an upper end of the tubing deflector including tubing and shroud latch assemblies.
Figure 12:
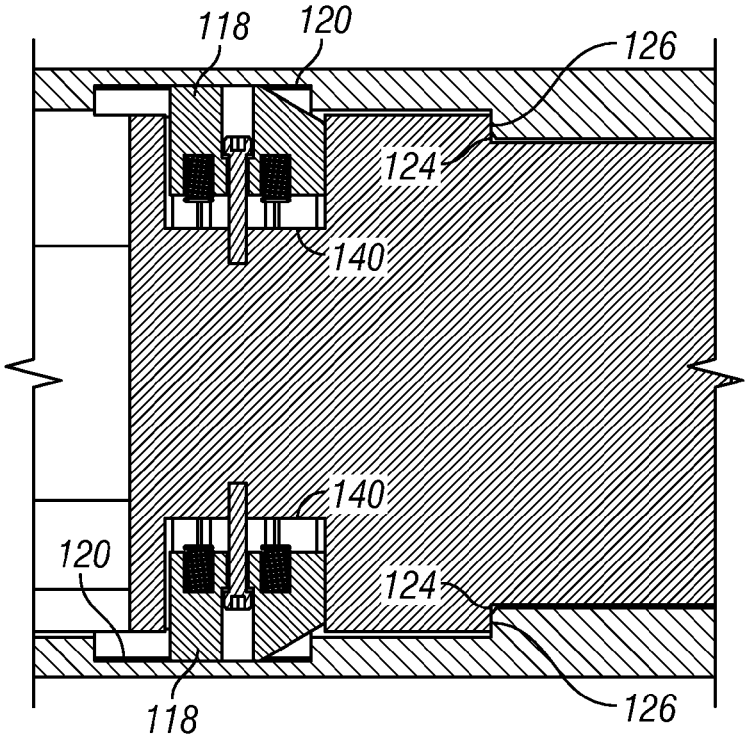
FIGS. 12 and 15 are cross-section views of an extended position of the deflector and latch assemblies of FIGS. 11 and 13.
Figure 13:
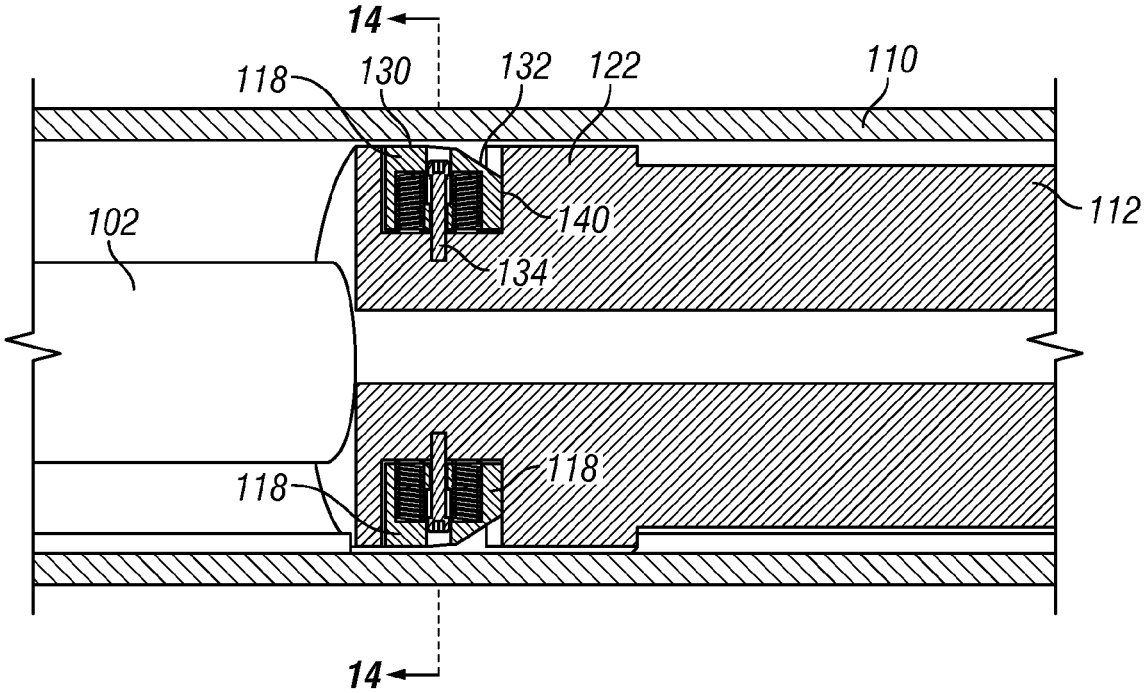
Figure 14:
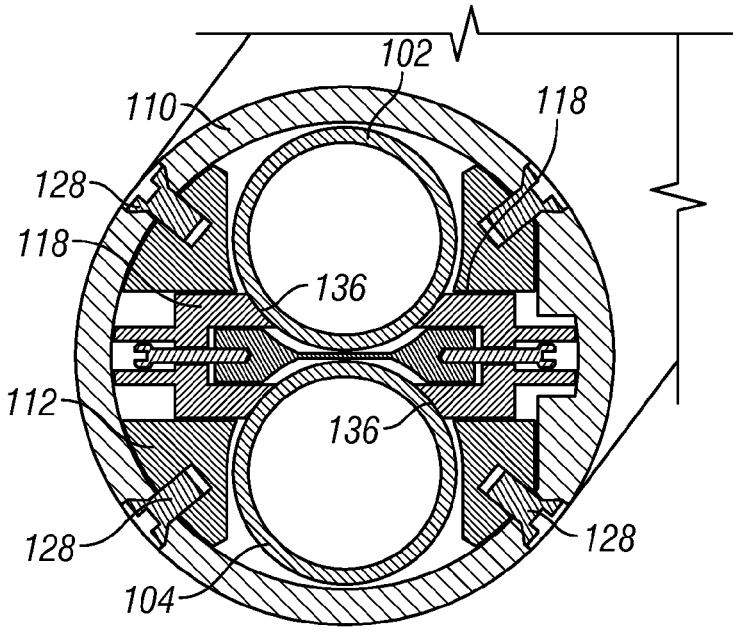
FIGS. 14 and 17 are radial section views of the deflector and latch assemblies of FIGS. 11 and 13.
Figure 15:
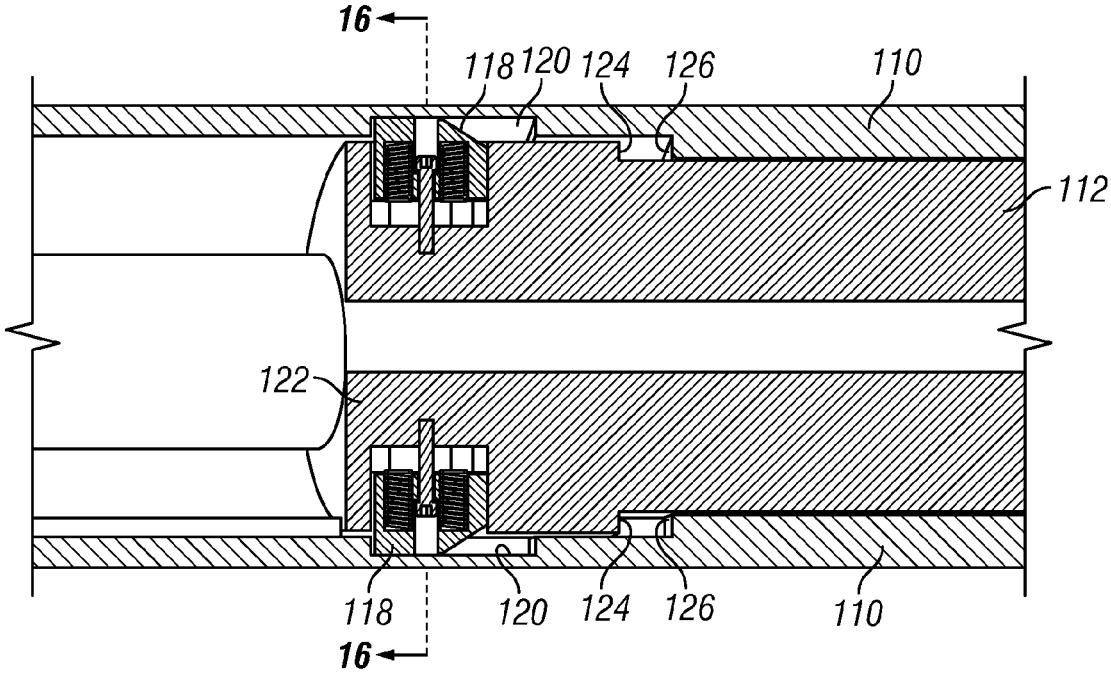
Figure 16:
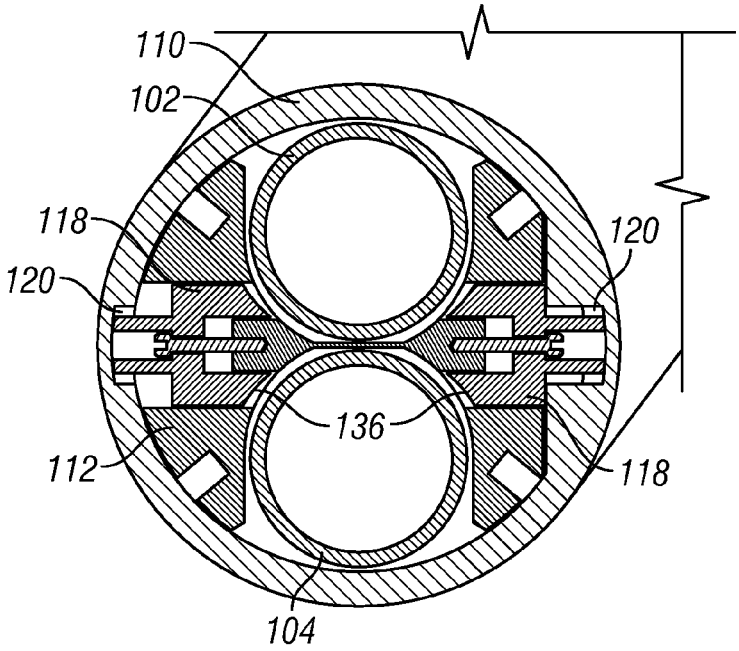
FIG. 16 is a radial section view of the deflector and latch assemblies of FIGS. 12 and 15.
Figure 17:
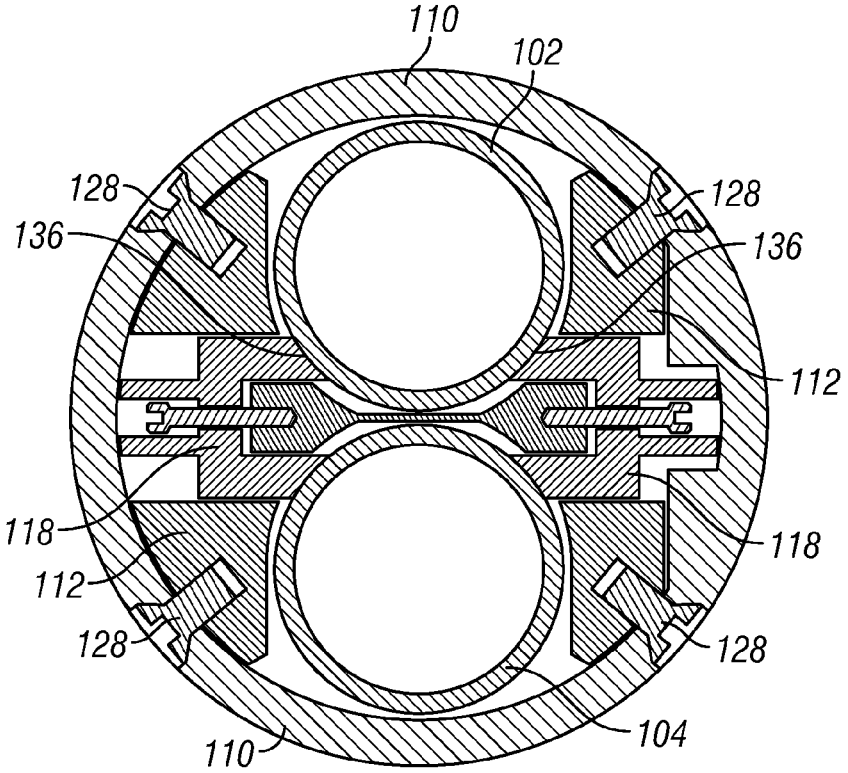
Figure 18:
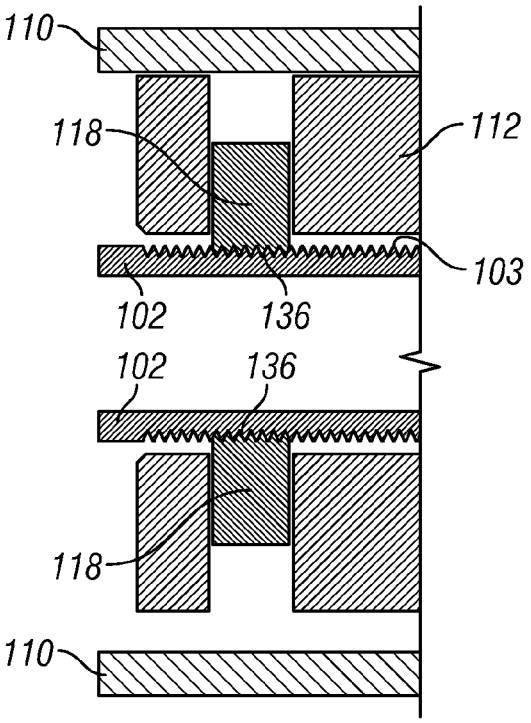
FIG. 18 is a section view of the gripping interface between the latch and the tubular member of the previous figures.

Referring to FIGS. 11-18, an upper end 122 of the tubing deflector 112 is shown. In FIGS. 11 and 13, a cross-section of the upper end 122 of the deflector 112 is shown disposed in the shroud 110 in the run-in or retracted position of FIG. 5. Spring-loaded latches 118 are disposed in pockets 140 in the deflector 112 and forced radially inward by the inner surface of the shroud 110. The latches 118 include an outer surface 130, a tapered surface 132 and a retaining pin 134 extending through a central bore. The radial section views of FIGS. 14 and 17 also show the latches 118 pressed radially inward by the shroud 110. Further, the latches 118 include gripping surfaces 136 for engaging the tubular members 102, 104 and preventing premature movement of the tubular members 102, 104 while the deflector 112 is in the retracted position. Referring briefly to FIG. 18, a section view shows the interface between the gripping surfaces 136 of the latches 118 and mating gripping surfaces 103 of the tubular members. FIGS. 14 and 17 also show that the deflector 112 is retained in the retracted position by a series of shear pins 128 disposed through the shroud 110 and into the deflector 112.

When the tubing deflector 112 is moved to its fully extended position, as shown in FIG. 7, the latches 118 are positioned adjacent recesses 120, as shown in FIGS. 12, 15 and 16. The spring-loaded latches 118 are now allowed to expand into the recesses 120, thereby shouldering against the recesses 120 as shown in FIG. 15 and preventing the deflector 112 from upward movement back into the shroud 110. Also, as shown in FIG. 16, the gripping surfaces 136 are released from engagement with the tubular members 102, 104. Thus, the latches 118 prevent movement of the tubular members 102, 104 during movement of the deflector 112 from the retracted position to the fully extended position, whereupon the latches 118 release the tubular members 102, 104. As shown in FIG. 12, a shoulder 124 on the deflector 112 can engage a shoulder 126 on the shroud 110 to prevent the deflector 112 from extending further in a downward direction.

Figure 19:
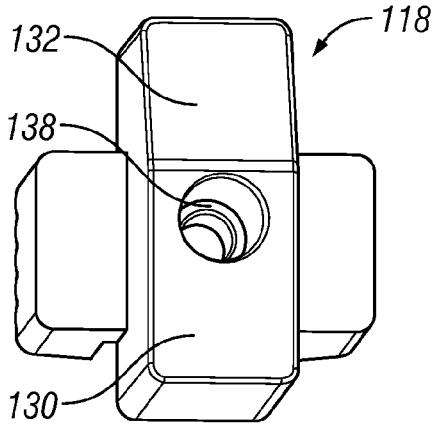
FIGS. 19-21 are various views of the latches of the previous figures.
Figure 20:
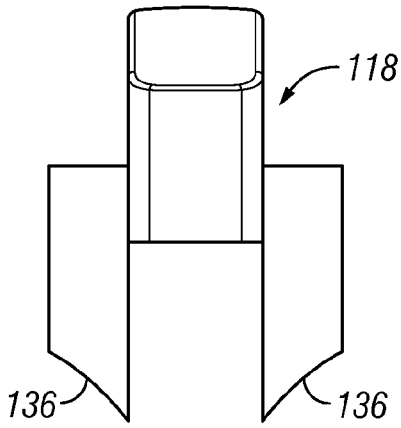
Figure 21:
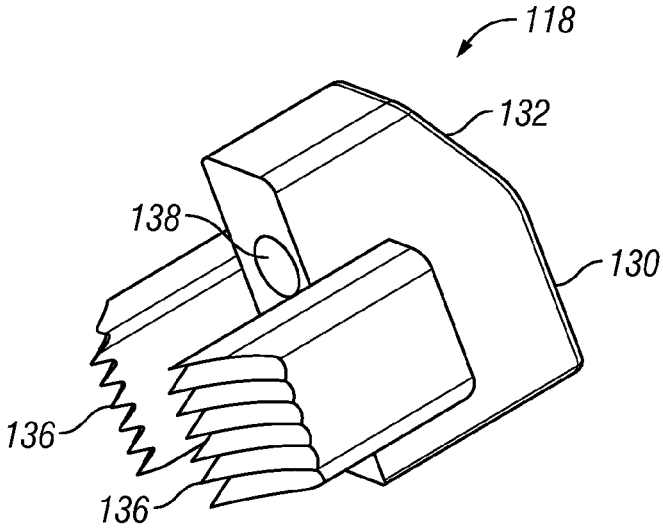
Figure 22:
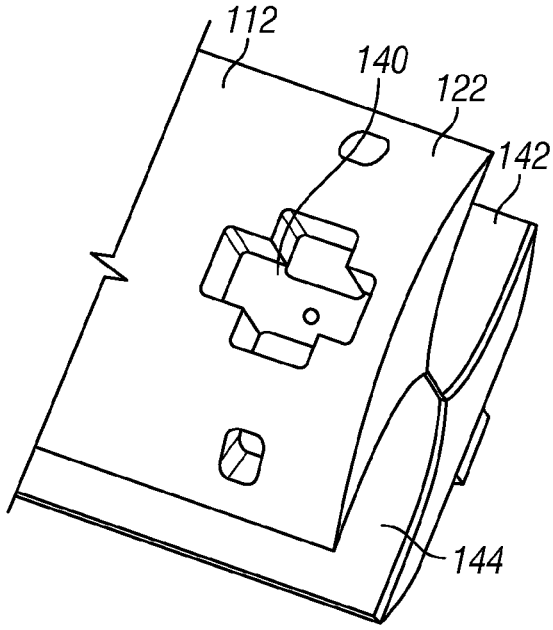
FIG. 22 is a perspective view of the upper end of the tubing deflector of the previous figures.

Referring now to FIGS. 19-22, the latches 118 are shown in further detail. FIG. 19 shows the top surfaces 130, 132 for contacting the shroud 110, and the central bore 138 for receiving the pin 134 that moveably retains the latch 118 for the spring-loaded action of the latch 118. FIG. 20 shows the lower gripping surfaces 136. FIG. 21 shows the upper surfaces 130, 132, the lower gripping surfaces 136 and the central bore 138. FIG. 22 shows the upper end 122 of the deflector 112 including the pocket 140 for the latch 118 and axial bores 142, 144 to receive the tubing strings 102, 104.

Figure 23:
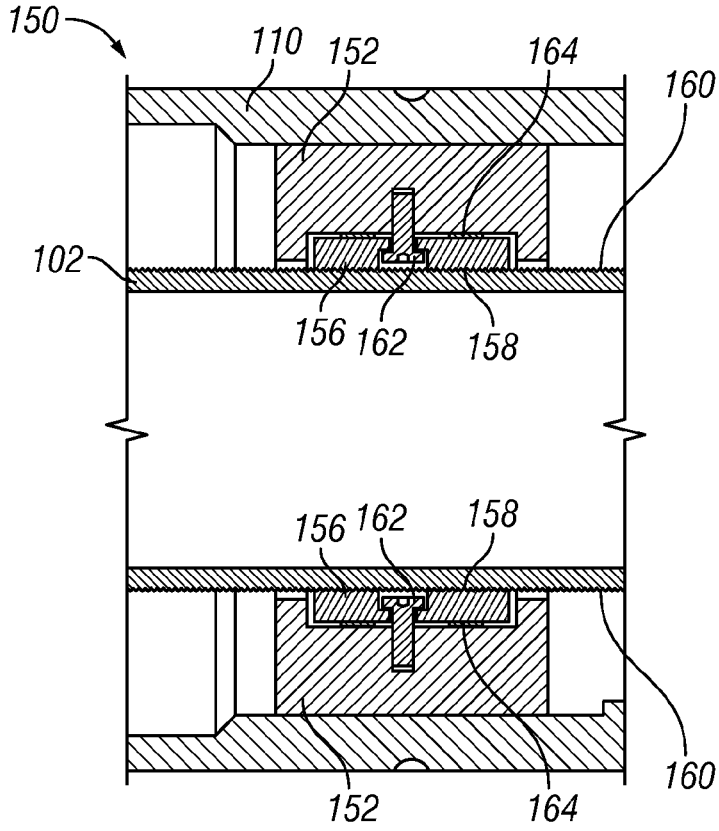
FIGS. 23 and 24 are cross-section views of a wicker assembly, taken in a different plane than the view of FIG. 11.
Figure 24:
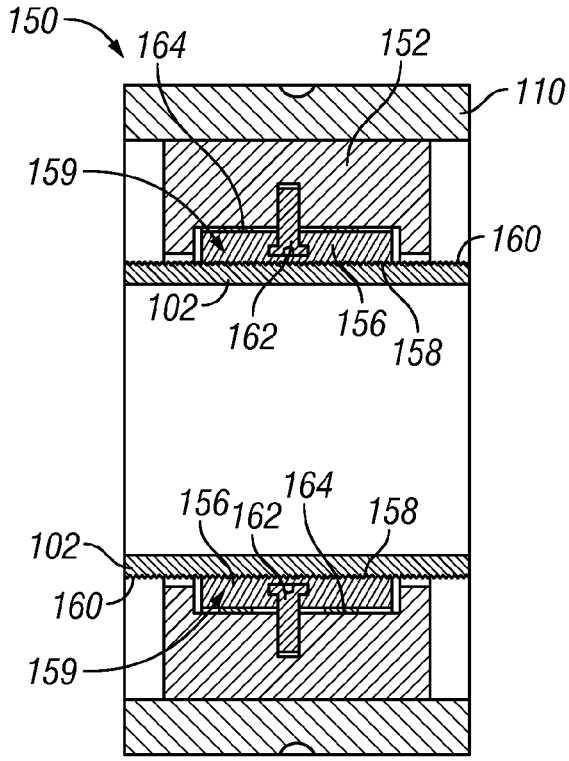

Referring back to FIG. 11, a wicker assembly 150 is provided between the shroud 110 and the tubular members 102, 104 just above the upper end 122 of the deflector 112 in the retracted position. The wicker assembly 150 includes support members 152 coupled to the shroud 110 with bolts 154. The tubular string 102 is provided with a gripping surface 160. Referring now to FIGS. 23 and 24, another cross-section of the assembly 100 in a slightly different plane than that of FIG. 11 shows that the wicker assembly 150 includes ratchet members 156 moveably coupled to the support members 152 by pins 162. The pins 162 allow radial movement of the ratchet members 156, and springs 164 are provided between the ratchet members 156 and the support members 152 to provide a biasing force toward the tubing string 102. The ratchet members 156 include gripping surfaces 158, and a portion of the tubing string 102 is provided with a gripping surface 160. The gripping surfaces 158, 160 are designed such that when they come together in a mating relationship, the interface 159 formed thereby and maintained by the spring-loaded ratchets 156 allow relative movement of the tubing string 102 in only one direction.

Figure 25:
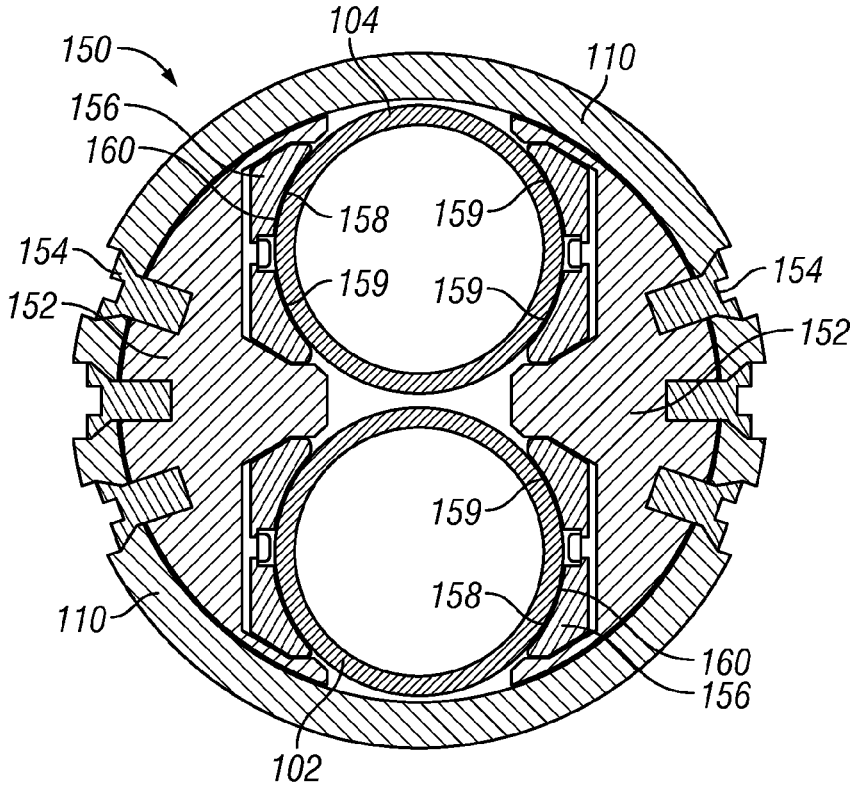
FIGS. 25 and 26 are radial section views of the wicker assembly of FIGS. 11, 23 and 24.
Figure 26:
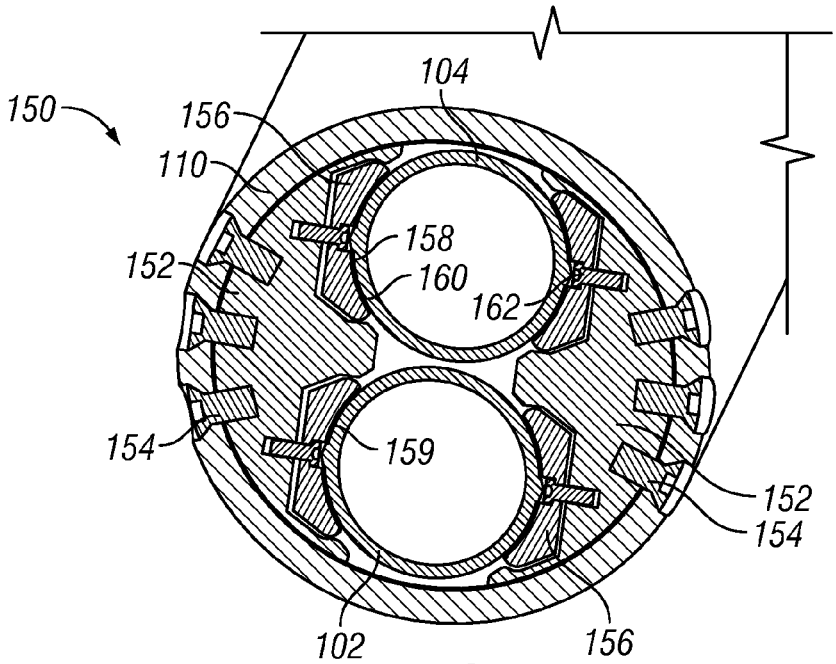
Figure 27:
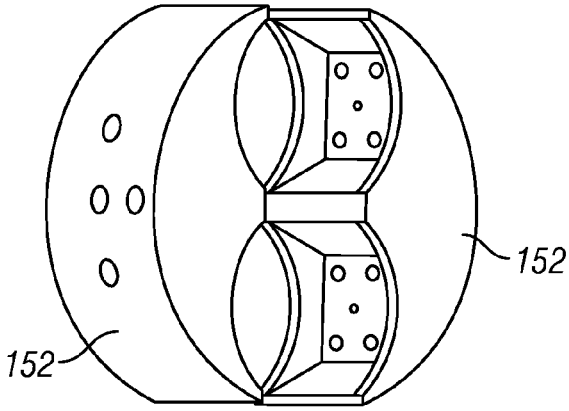
FIG. 27 is an isolated perspective view of the wicker assembly support members.
Figure 28:
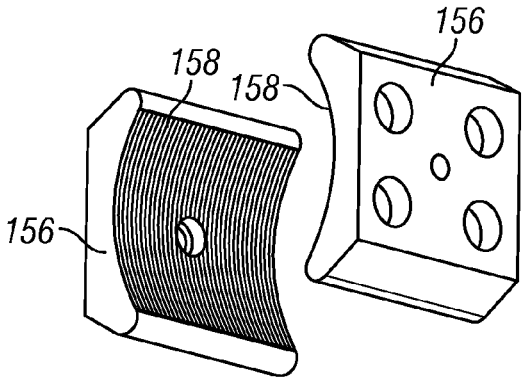
FIG. 28 is an isolated perspective view of the wicker assembly ratchet members.

Referring to FIGS. 25 and 26, a radial section of the wicker assembly 150 shows that the support members 152 are coupled to the shroud 110 by the bolts 154, and the ratchet members 156 are moveably coupled to the support members 152 by the pins 162 and spring-loaded to form a uni-directional gripping interface 159 between the gripping surfaces 158, 160. Thus, the tubing strings 102, 104 can only move in one direction relative to the shroud 110 when the appropriate force is applied. Typically, this movement will be downward toward the main and lateral boreholes for entry into the boreholes. Upward movement of the tubing strings 102, 104 will be prevented, thus making the wicker assembly 150 a retrieval device for the Y-block 100. The tubing strings 102, 104 may be lifted to return the assembly 100 to the surface. FIG. 27 shows an isolated perspective view of the support members 152. FIG. 28 shows an isolated perspective view of the ratchet members 156 having gripping surfaces 158.

Figure 29:
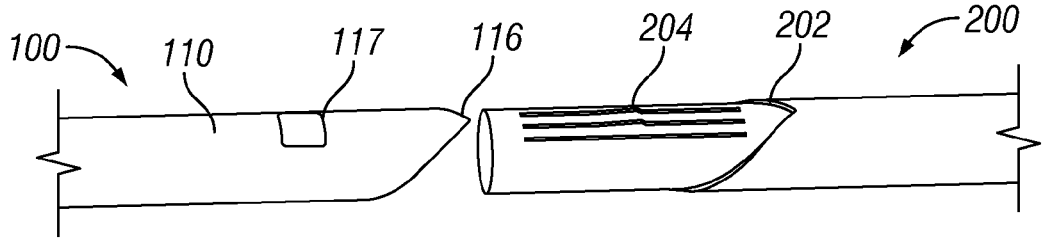
FIGS. 29-45 are various assembly and operational views of the embodiments of the deflector and multiple tubing string assembly during use.
Figure 30:
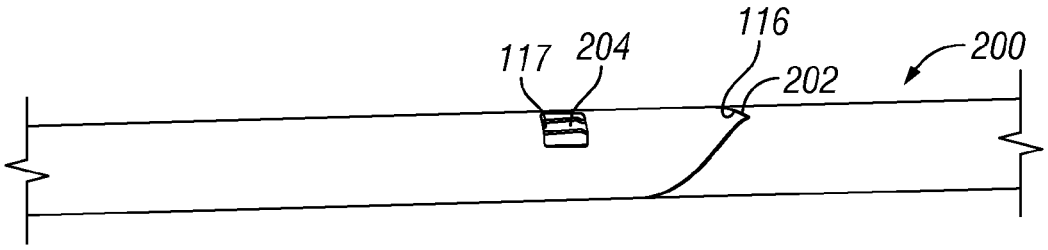
Figure 31:
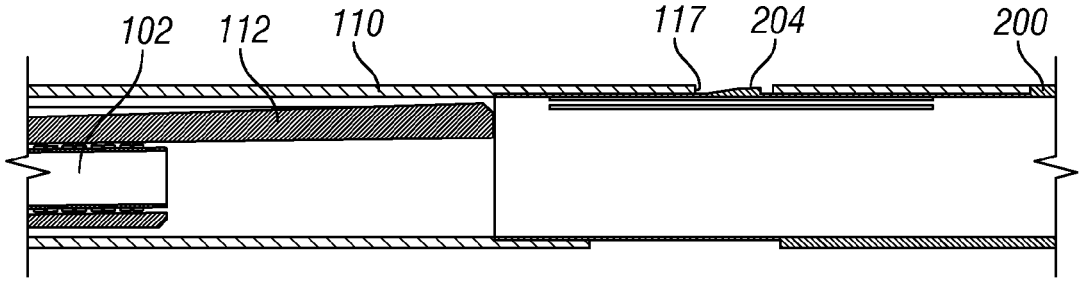
Figure 32:
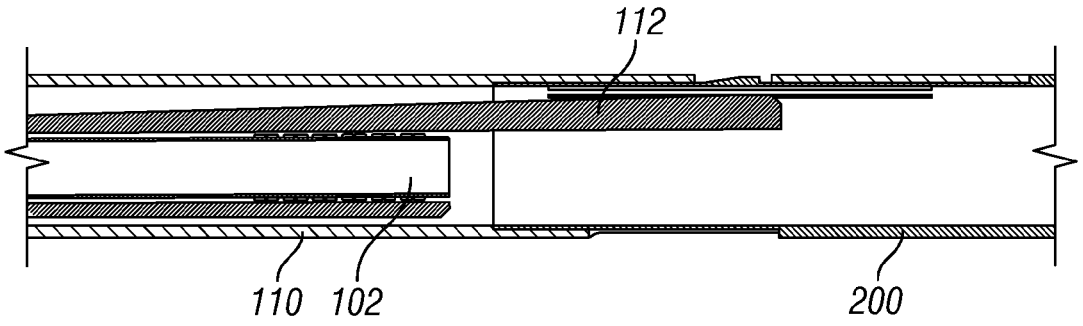
Figure 33:
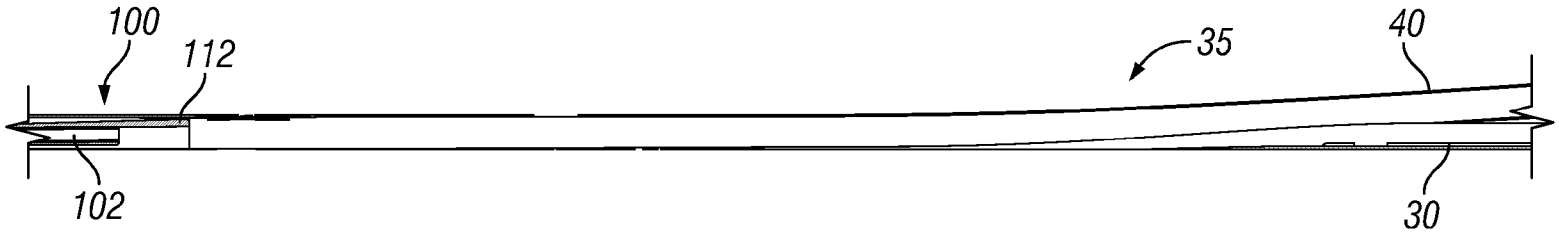
Figure 34:
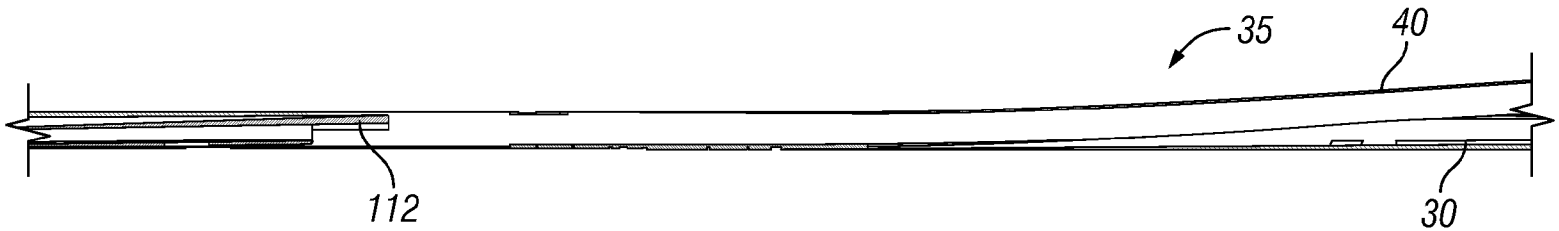
Figure 35:
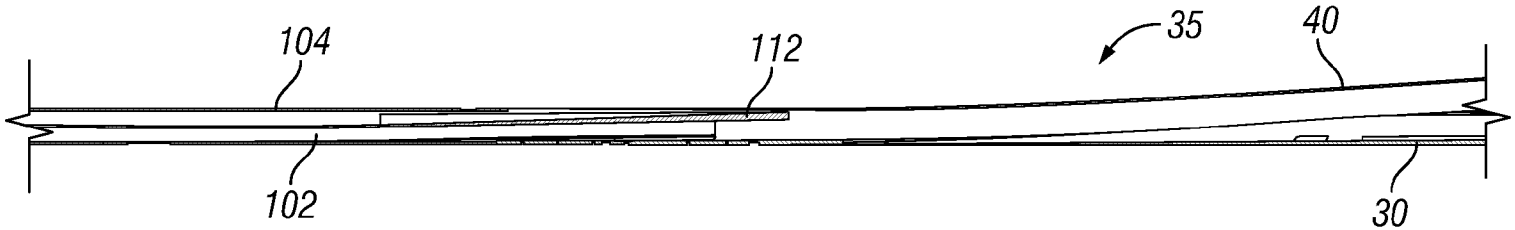
Figure 36:
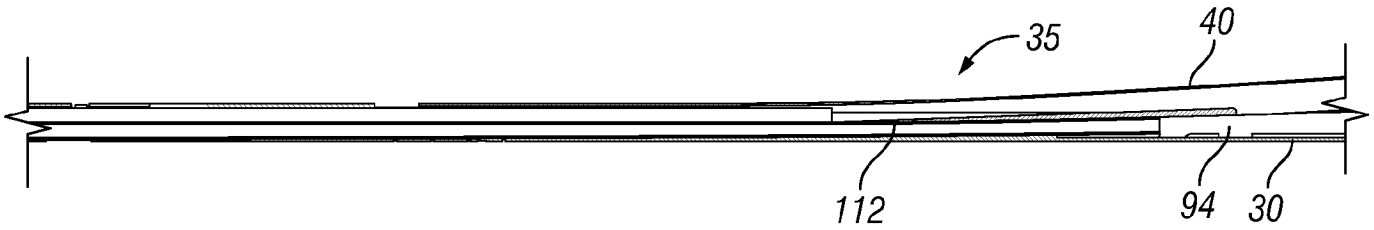

In operation, the production tubing assembly 100 is lowered into the primary borehole where a mule shoe or other locator 200 is secured, as shown in FIG. 29. The mule shoe 200 includes a profile 202 and collets snaps 204. The assembly 100 is lowered toward the mule shoe 200, with the assembly 100 including the end 116 with a mating mule shoe profile and a receptacle 117. As shown in FIG. 30, the profiles 116, 202 mate to orient and secure the assembly 100 in the borehole. Collets 204 snap into the receptacle 117. A cross-section view of the connection in FIG. 30, as shown in FIG. 31, illustrates the retracted position of the deflector 112 and tubing 102 assembly in the shroud 110. Upon application of a force or set down weight on the deflector and tubing assembly via the production tubings, the shear pins 128 (FIG. 14) are sheared and the deflector 112 with coupled tubulars 102, 104 begins to advance toward the junction 35 and the main and lateral bores, as shown in FIG. 33. In FIG. 34, the Y-block deflector 112 is shown continuing to advance toward the junction 35. In FIG. 35, the deflector 112 has advanced into the junction 35, bringing the tubing strings 102, 104 along behind it. As shown in FIG. 36, the deflector 112 has been fully extended into the junction 35. The main borehole may be provided with an integral deflector 94.

Figure 37:
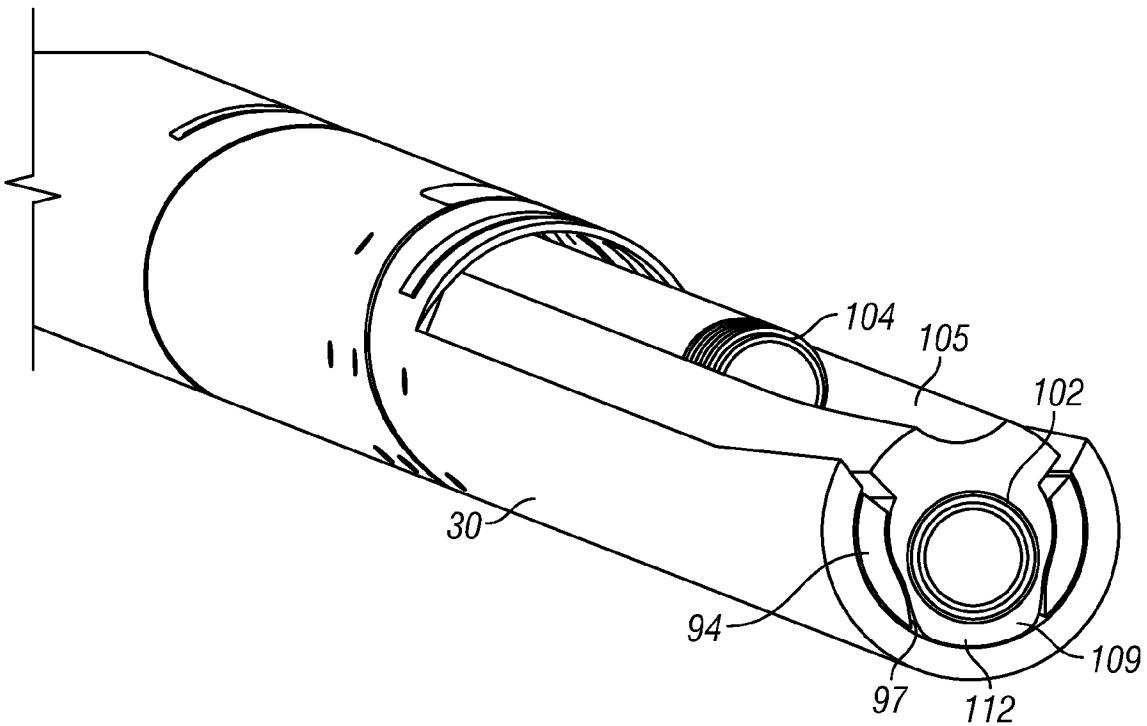
Figure 38:
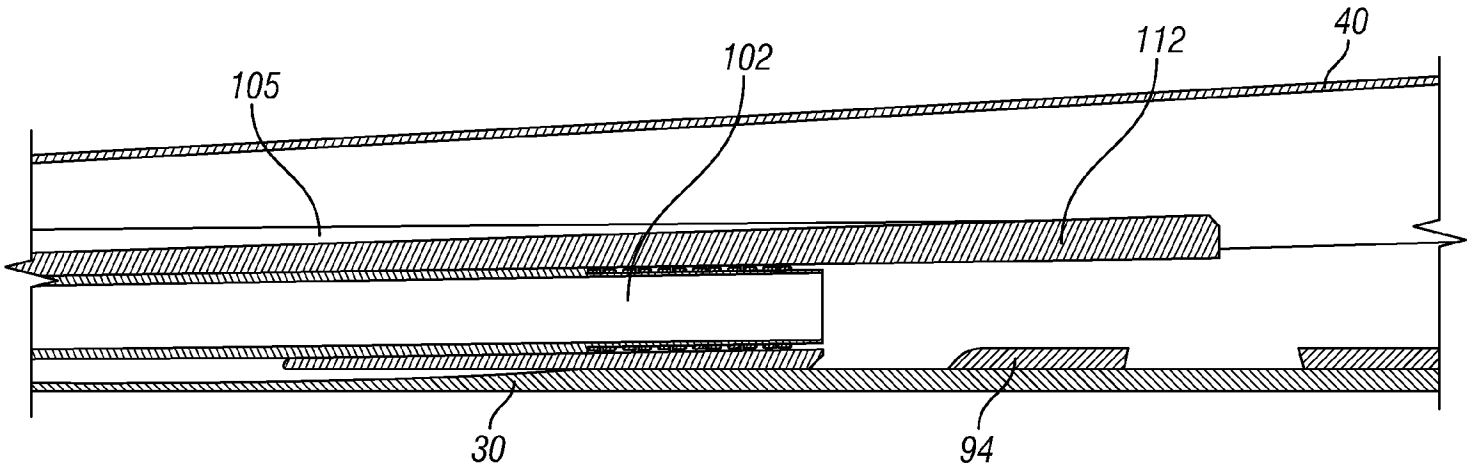
Figure 39:
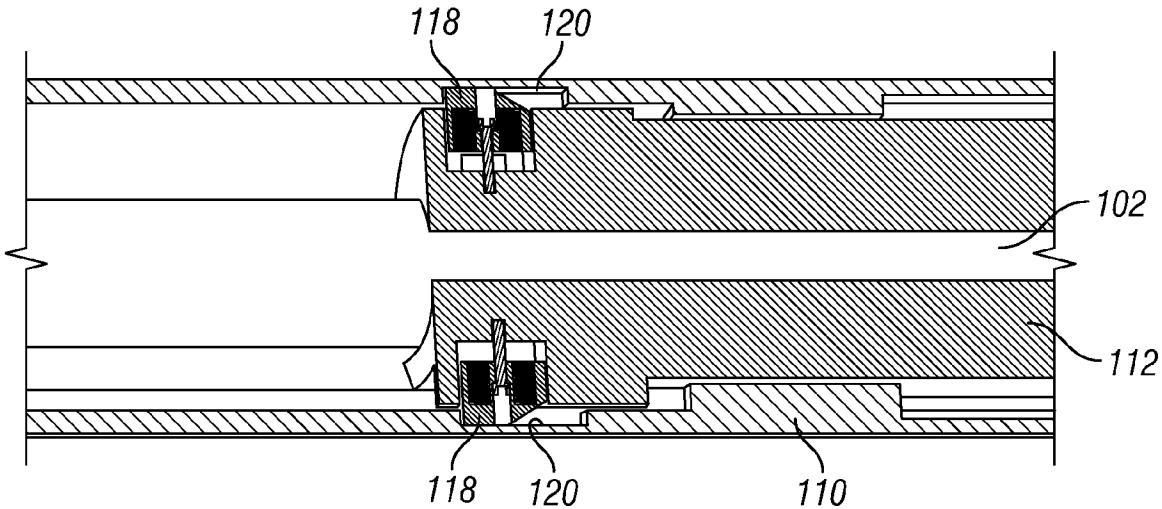
Figure 40:
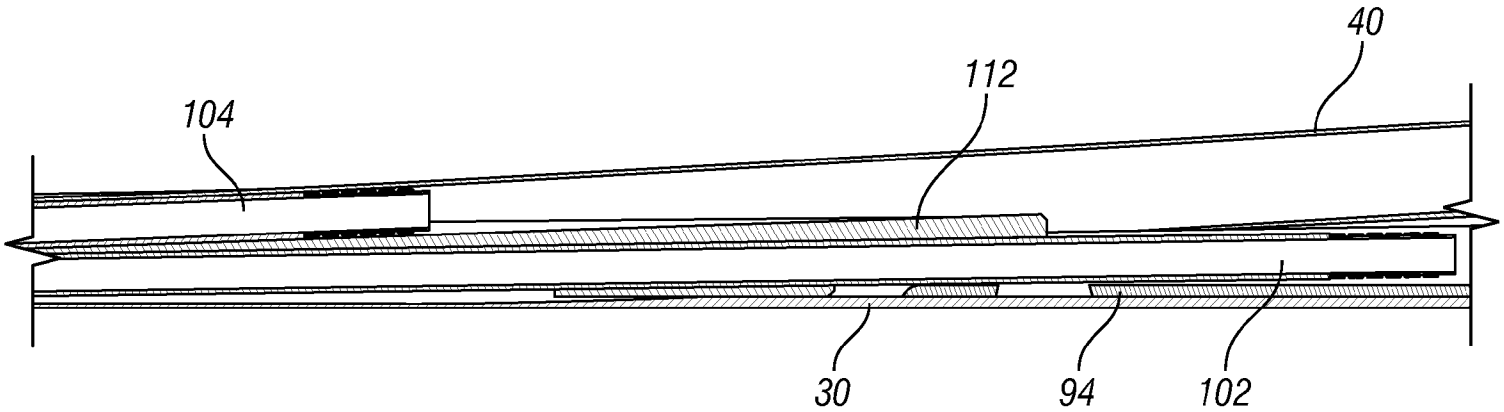
Figure 41:
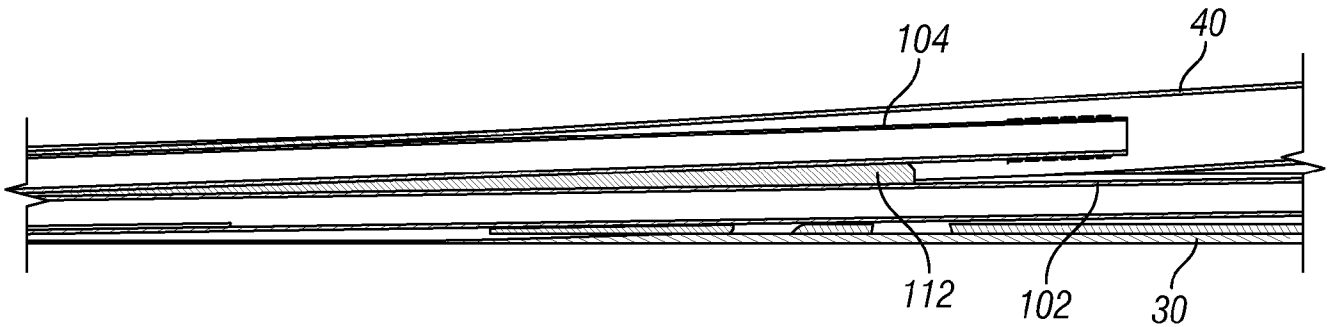

Referring to FIG. 37, the fully extended Y-block tubing deflector assembly is shown in a perspective view. The main borehole 30 includes the integral deflector 94 which has received the Y-block deflector 112. The deflector 112 houses the main bore tubing string 102, and also provides a ramp 105 for supporting the lateral tubing string 104 adjacent the string 102. A cross-section view of the fully extended deflector assembly is shown in FIG. 38, including the main bore 30 with the integral deflector 94, the lateral bore 40 and the deflector 112 housing the main tubular string 102 and having the ramp 105. As shown in FIG. 39, and previously described with respect to FIGS. 12, 15 and 16, the spring-loaded latches 118 are forced into the recesses 120 to, first, prevent upward movement of the deflector 112, and, second, release the tubing string 102 for advancement into the lower boreholes 30, 40. Now, as shown in FIGS. 40 and 41, a force or set down weight is again applied to the tubing strings 102, 104 such that they are advanced into their respective boreholes for mating engagement with the polished bore receptacles 72, 82 (FIG. 3).

Figure 42:
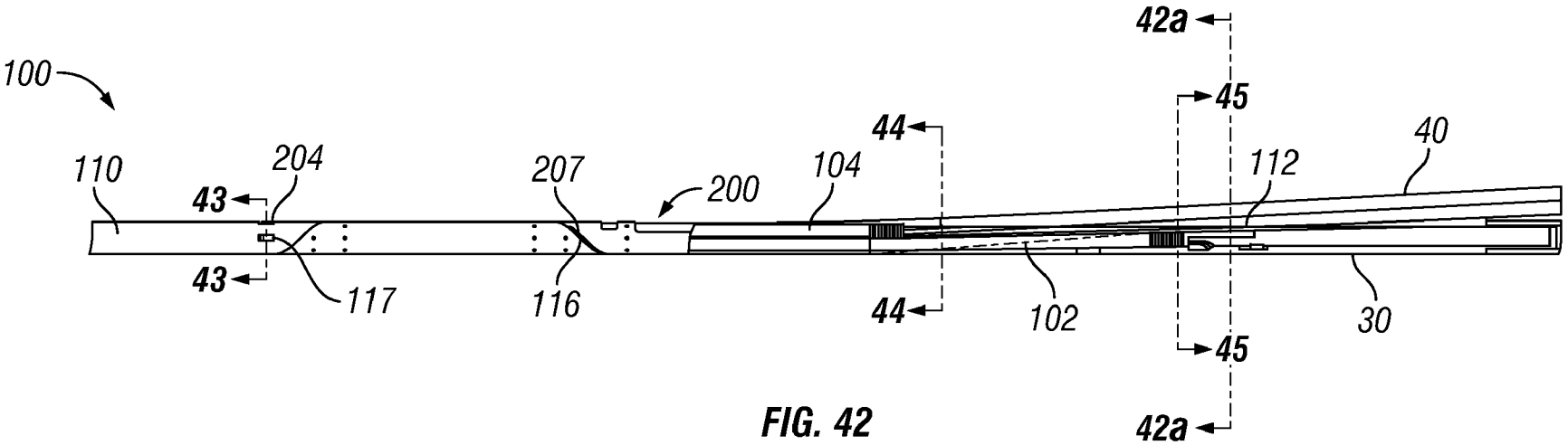
Figure 42A:
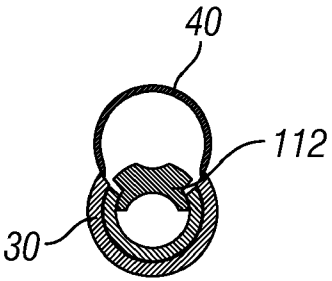
Figure 45:
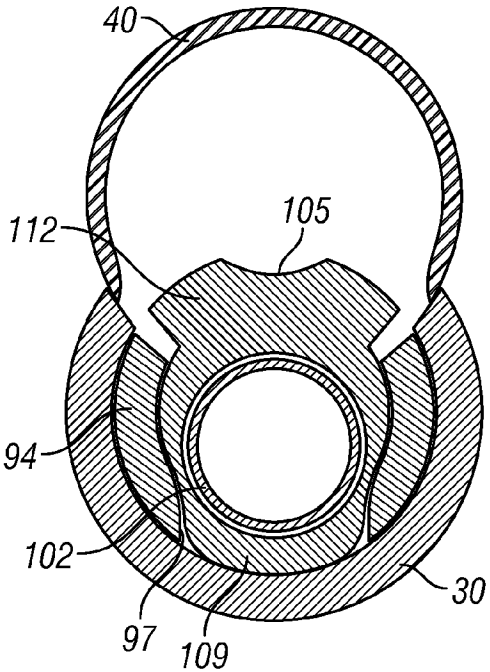
Figure 44:
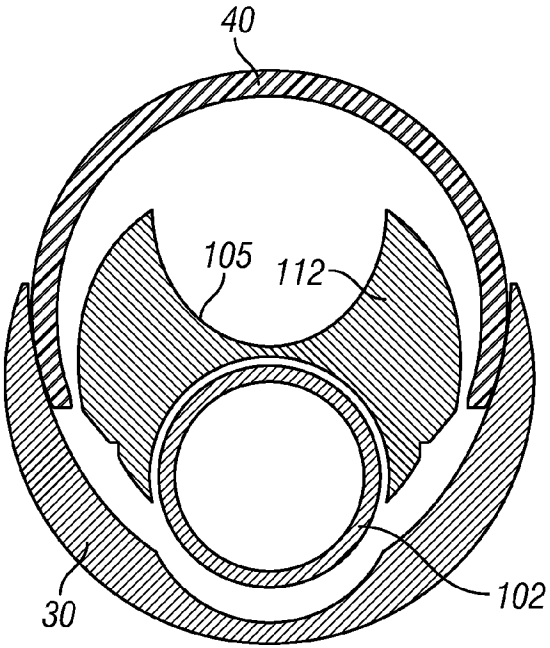
Figure 43:
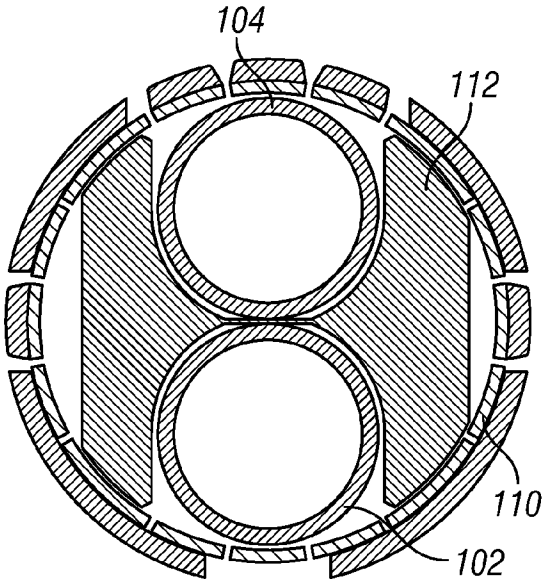

With reference to FIGS. 42-45, more detailed views of the fully extended deflector and tubing assembly inside the borehole junction can be seen pursuant to the description provided above. The tubing and deflector assembly 100 is engaged with the mule shoe 200 at the mating orientation profiles 116, 202 and the collets 204 snapped into the receptacles 117. A cross-section at 42*a*-42*a* depicts a bottom-up view of the assembly 100 disposed in the junction between boreholes 30, 40, wherein the deflector 112 and other components are arranged as shown in FIG. 42*a*. As shown in FIG. 43, a cross-section at an upper end of the assembly illustrates the side-by-side or adjacent tubulars 102, 104 supported and separated by the deflector 112 disposed in the shroud 110. In FIG. 44, an intermediate cross-section shows the tubular 102 and the deflector 112 disposed in the junction between boreholes 30, 40. The deflector 112 includes a ramp 105 for receiving and guiding the tubular 104. In FIG. 45, a lower cross-section depicts the deflector 112 encompassing the tubular 102 while the deflector 112 has also been guided through a central passageway of the integral deflector 94 anchored in the primary borehole 30.

As shown in FIGS. 37 and 45, the deflector 112 is aligned in the borehole using its shape and interaction with other components. For example, a lower lobe 109 of the deflector 112 slidingly mates with a central passageway 97 of the integral deflector 94. Thus, the several features described herein provide a self-aligning deflector and tubing assembly for inserting multiple tubulars into multiple boreholes for production access.

The embodiments set forth herein are merely illustrative and do not limit the scope of the disclosure or the details therein. It will be appreciated that many other modifications and improvements to the disclosure herein may be made without departing from the scope of the disclosure or the inventive concepts herein disclosed. Because many varying and different embodiments may be made within the scope of the inventive concept herein taught, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A production tubing assembly for accessing multiple boreholes comprising:

an outer shroud having an axial throughbore;

a deflector disposed in the axial throughbore and releasably coupled to the outer shroud; and at least two tubular members releasably coupled to the deflector by extendable latch assemblies;

wherein the deflector with the coupled tubular members is extendable from within the outer shroud to an extended position beyond the outer shroud;

wherein, in the extended position, the latch assemblies move to release the tubular members and latch the deflector to the outer shroud.

2. The assembly of claim 1 wherein the deflector is extendable toward a junction with a main borehole and a lateral borehole.

3. The assembly of claim 2 wherein the tubular members are further extendable into the main and lateral boreholes.

4. The assembly of claim 2 wherein the deflector is aligned in the main borehole and is slidingly received by an integral deflector in the main borehole.

5. The assembly of claim 2 wherein the deflector includes a ramp to deflect one of the tubular members into the lateral borehole.

6. The assembly of claim 2 further comprising a locator disposed above the junction to receive an orientation profile on the outer shroud.

7. The assembly of claim 1 wherein the deflector is releasably coupled to the outer shroud by shear members.

8. The assembly of claim 1 wherein the latch assemblies comprise spring-loaded latch members.

9. The assembly of claim 8 wherein the latch members comprise an outer latch surface and an inner tubular gripping surface.

10. The assembly of claim 8 wherein the latch members, in the extended position, are biased by the springs into recesses in the outer shroud.

11. The assembly of claim 1 further comprising a wicker assembly coupled between the tubular members and the outer shroud for one directional movement of the tubular members relative to the outer shroud.

12. The assembly of claim 11 wherein the wicker assembly allows downward movement of the tubular members and prevents upward movement of the tubular members for retrieval of the assembly.

13. The assembly of claim 11 wherein the wicker assembly comprises spring-loaded ratchet members.

14. The assembly of claim 13 wherein the ratchet members include gripping surfaces and the tubular members include mating gripping surfaces to form a uni-directional gripping interface.

15. A production tubing assembly for accessing multiple boreholes comprising:

an outer shroud having an axial throughbore and an inner recess;

a deflector slidably disposed in the axial throughbore and releasably coupled to the outer shroud;

at least two tubular members supported by and releasably coupled to the deflector; and a latch assembly disposed in a portion of the deflector between the outer shroud and the two tubular members for the releasable coupling thereto, wherein in an extended position beyond the outer shroud, the latch assembly moves to release the tubular members, the latch assembly comprising at least one latch member having a tubular gripping surface and a latch surface to engage the inner recess of the outer shroud for latching the deflector thereto.

16. The assembly of claim 15 wherein the deflector includes a retracted position wherein the outer shroud forces the latch member gripping surface into engagement with one of the tubular members, and wherein in the extended position the latch member is biased into the inner recess of the outer shroud to release the gripping surface from the tubular member and latch the deflector to the outer shroud.

17. The assembly of claim 15 further comprising a wicker assembly coupled between at least one of the tubular members and the outer shroud, the wicker assembly including at least one ratchet member having a gripping surface mating with a gripping surface of the tubular member to form a uni-directional gripping interface.

18. A method for accessing multiple boreholes with a production tubing assembly comprising:

lowering the tubing assembly into a primary well, wherein the tubing assembly comprises a deflector coupled to an outer shroud and at least two tubular members coupled to the deflector;

disposing the tubing assembly adjacent a junction between a main borehole and a lateral borehole;

releasing the deflector from the outer shroud;

extending the deflector and the tubular members from the outer shroud to a position there-beyond;

releasing the tubular members from the deflector;

latching the deflector to the outer shroud; and extending the tubular members into the main and lateral boreholes.

19. The method of claim 18 further comprising:

coupling the deflector to the outer shroud with shear members; and wherein releasing the deflector from the outer shroud comprises shearing the shear members.

20. The method of claim 18 further comprising:

coupling the two tubular members to the deflector with latch members having gripping surfaces; and wherein releasing the tubular members from the deflector and latching the deflector to the outer shroud comprises biasing the latch members away from the tubular members and into recesses in the outer shroud.

21. The method of claim 18 further comprising:

lifting the two tubular members; and retrieving the tubing assembly to the surface of the primary well.

22. The method of claim 21 wherein retrieving the tubing assembly to the surface of the primary well further comprises:

coupling a wicker assembly between the two tubular members and the outer shroud; and wherein the wicker assembly comprises a uni-directional gripping interface with the tubular members allowing downward movement of the tubular members relative to the outer shroud and preventing upward movement of the tubular members relative to the outer shroud.

* * * * *